US011176788B2

(12) United States Patent
Tran et al.

(10) Patent No.: US 11,176,788 B2
(45) Date of Patent: Nov. 16, 2021

(54) EMERGENCY NOTIFICATION SYSTEM AND METHOD

(71) Applicant: Johnson Controls Fire Protection LP, Boca Raton, FL (US)

(72) Inventors: Liem-Binh Tran, Saint-Hubert (CA); Eric Caron, Anjou (CA); Kim Bouchard, Montreal (CA)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 16/712,290

(22) Filed: Dec. 12, 2019

(65) Prior Publication Data

US 2021/0183217 A1 Jun. 17, 2021

(51) Int. Cl.
*G08B 7/06* (2006.01)
*G08B 21/02* (2006.01)

(52) U.S. Cl.
CPC ..... *G08B 7/062* (2013.01); *G08B 7/066* (2013.01); *G08B 21/02* (2013.01)

(58) Field of Classification Search
CPC ..... G08B 7/062
See application file for complete search history.

(56) References Cited

U.S. PATENT DOCUMENTS 5,559,492 A 9/1996 Stewart et al.
5,576,690 A 11/1996 Waugh et al.
5,622,427 A 4/1997 Lemons et al.
5,659,287 A 8/1997 Donati et al.
5,815,068 A 9/1998 Vadseth
5,865,527 A 2/1999 Lemons et al.
6,014,596 A 1/2000 Bess et al.
6,025,773 A 2/2000 Bresnan
6,310,551 B1 10/2001 Croft
6,426,697 B1 7/2002 Capowski et al.
6,538,568 B2 3/2003 Conley, III
7,456,585 B2 11/2008 Savage, Jr. et al.
(Continued)

OTHER PUBLICATIONS

Non-Final Office Action for U.S. Appl. No. 15/004,420 dated Dec. 23, 2016, 10 pages.

(Continued)

*Primary Examiner* — Travis R Hunnings
(74) *Attorney, Agent, or Firm* — Arent Fox LLP

(57) ABSTRACT

A computer device for communicating an emergency notification receives an alarm notification from a detection device. The alarm notification corresponding to an alarm condition sensed by the detection device within a space. The computer device detects an alarm condition location of the alarm condition based on a detection device location of the detection device. The computer device determines an exit location of an exit to avoid the alarm condition that triggered the alarm notification. The computer device determines an egress path within the space to avoid the alarm condition based on the exit location and the alarm condition location. The computer device transmits a plurality of commands to a plurality of notification devices within the space to trigger output of an egress notification in a coordinated pattern to identify the egress path. The plurality of commands trigger audible outputs by the plurality of notification devices.

22 Claims, 6 Drawing Sheets

(56) References Cited

U.S. PATENT DOCUMENTS

| | | | |
|---|---|---|---|
| 7,999,666 | B2 | 8/2011 | Barrieau et al. |
| 8,368,528 | B2 | 2/2013 | Savage, Jr. et al. |
| 8,378,806 | B2 | 2/2013 | Piccolo, III |
| 8,558,711 | B2 | 10/2013 | Savage, Jr. et al. |
| 8,723,682 | B2 | 5/2014 | Savage, Jr. et al. |
| 8,773,276 | B2 | 7/2014 | Savage, Jr. et al. |
| 8,796,931 | B2 | 8/2014 | Savage, Jr. et al. |
| 8,845,136 | B2 | 9/2014 | Savage, Jr. et al. |
| 8,890,707 | B2 | 11/2014 | Savage, Jr. et al. |
| 8,890,708 | B2 | 11/2014 | Savage, Jr. et al. |
| 9,185,774 | B2 | 11/2015 | Savage, Jr. et al. |
| 9,345,082 | B2 | 3/2016 | Savage, Jr. et al. |
| 9,355,535 | B2 | 5/2016 | Savage, Jr. et al. |
| 9,466,186 | B2 | 10/2016 | Savage, Jr. et al. |
| 9,922,509 | B2 | 3/2018 | Marien |
| 2005/0073405 | A1 | 4/2005 | Spoltore et al. |
| 2005/0128097 | A1 | 6/2005 | Piccolo, III |
| 2005/0286247 | A1 | 12/2005 | Peterson |
| 2006/0038686 | A1 | 2/2006 | Casden |
| 2006/0038696 | A1 | 2/2006 | Arcaria et al. |
| 2007/0035255 | A1 | 2/2007 | Shuster et al. |
| 2007/0069882 | A1 | 3/2007 | Mahajan |
| 2008/0022414 | A1 | 1/2008 | Cahn et al. |
| 2008/0266121 | A1 | 10/2008 | Ellul |
| 2009/0027225 | A1 | 1/2009 | Farley |
| 2009/0059602 | A1 | 3/2009 | Santos et al. |
| 2010/0207777 | A1 | 8/2010 | Woodford |
| 2012/0038479 | A1 | 2/2012 | Ten Wolde |
| 2012/0238319 | A1 | 9/2012 | Lake |
| 2012/0319860 | A1 | 12/2012 | Savage, Jr. |
| 2013/0049985 | A1 | 2/2013 | Eisenson et al. |
| 2013/0194063 | A1 | 8/2013 | Keller et al. |
| 2014/0009301 | A1 | 1/2014 | Robotham et al. |
| 2014/0139539 | A1* | 5/2014 | Byers ..... G09G 5/10 345/589 |
| 2015/0339913 | A1 | 11/2015 | Lyman et al. |
| 2016/0007179 | A1* | 1/2016 | Kim ..... G08B 7/066 455/404.1 |
| 2016/0035200 | A1 | 2/2016 | Savage, Jr. et al. |
| 2016/0035201 | A1 | 2/2016 | Savage, Jr. et al. |
| 2016/0049053 | A1 | 2/2016 | Simmons |
| 2016/0123741 | A1* | 5/2016 | Mountain ..... H04N 5/44 701/533 |
| 2016/0247369 | A1* | 8/2016 | Simmons ..... G08B 7/066 |
| 2016/0275761 | A1* | 9/2016 | Tanaka ..... H05B 47/105 |
| 2016/0292978 | A1* | 10/2016 | Lee ..... G08B 1/08 |
| 2019/0189147 | A1 | 6/2019 | Montieth et al. |

OTHER PUBLICATIONS

Election/Restriction Requirement for U.S. Appl. No. 15/004,420 dated Jun. 12, 2017, 7 pages.

* cited by examiner

EMERGENCY NOTIFICATION SYSTEM AND METHOD

TECHNICAL FIELD

The disclosure relates generally to the field of notification systems, and more particularly to a system and a method for an emergency notification.

BACKGROUND

One of the issues with notification systems relates to notifying users or occupants of a building to use standard notification systems to indicate an emergency and occupants exiting through a standard predetermined path in case of an emergency.

Existing systems may indicate the presence of an emergency situation with synchronized strobe lights and/or sounds/horns. Yet, these alerts merely provide an occupant with notice of the emergency situation. Thus, improvements in notification systems are desired.

SUMMARY

In view of the forgoing, a system and method are disclosed for communicating an emergency notification. The described system and method may, in some cases, indicate the location of the emergency exit and/or the path to the exit. Such as system may be helpful to occupants during emergency situations, helping the occupants to quickly locate exits before walking towards them. Additionally, the present solutions may be helpful in the presence of smoke and/or other environmental factors, which otherwise may make it difficult for an occupant to locate the emergency exit in an emergency situation. Also, the present solutions may provide assistance to occupants with visual or hearing impairment, who otherwise may have difficulty locating the emergency exit.

In an aspect, the system and method may allow a processor to receive, an alarm notification from a detection device, wherein the alarm notification corresponds to an alarm condition sensed by the detection device within a space. The system and method may detect an alarm condition location of the alarm condition based on a detection device location of the detection device. The system and method may determine an exit location of an exit to avoid the alarm condition that triggered the alarm notification. The system and method may determine an egress path within the space to avoid the alarm condition based on the exit location and the alarm condition location. The system and method may transmit a plurality of commands to a plurality of notification devices within the space to trigger output of an egress notification in a coordinated pattern to identify the egress path, wherein the plurality of commands trigger audible outputs by the plurality of notification devices.

In an additional or alternative aspect, the system and method may generate, by the plurality of notification devices, the audible outputs in the coordinated pattern in response to receiving the plurality of commands.

In an additional or alternative aspect, the system and method may have the alarm condition comprising a first alarm condition, and the egress path comprising a first set of egress paths based on a first alarm condition location of the first alarm condition. The system and method may receive a second alarm notification from a second detection device, wherein the second alarm notification corresponds to a second alarm condition sensed by the second detection device within the space. The system and method may detect a second alarm condition location of the second alarm condition based on a second detection device location of the second detection device, wherein the second alarm condition location is different from the first alarm condition location. The system and method may determine a second set of egress paths within the space to avoid both the first alarm condition and the second alarm condition location, wherein the second set of egress paths is different from the first set of egress paths. The system and method may transmit a plurality of second commands to a second plurality of notification devices within the space to trigger output of a second egress notification in a second coordinated pattern to identify the second set of egress paths, wherein the plurality of second commands trigger second audible outputs by the second plurality of notification devices.

In an additional or alternative aspect, the system and method may have the alarm condition comprising a first alarm condition, and the egress path comprising a first set of egress paths based on a first alarm condition location of the first alarm condition. The system and method may receive a second alarm notification from a second detection device, wherein the second alarm notification corresponds to a second alarm condition sensed by the second detection device within the space. The system and method may detect a second alarm condition location of the second alarm condition based on a second detection device location of the second detection device, wherein the second alarm condition location is different from the first alarm condition location. The system and method may determine unavailability of a second set of egress paths within the space to avoid both the first alarm condition and the second alarm condition location, wherein the second set of egress paths is different from the first set of egress paths. The system and method may transmit a plurality of second commands to the plurality of notification devices to output a second egress notification, wherein the second egress notification comprises a non-directional notification.

In an additional or alternative aspect, the system and method may detect the alarm condition location by determining the detection device location of the detection device, and determining the alarm condition location of the source of the alarm notification based on the detection device location and one or more categorized locations in a vicinity of the detection device.

In an additional or alternative aspect, the system and method may determine the exit location by determining candidate exit locations based on the alarm condition location, determining a nature of the alarm condition that triggered the alarm notification based on input from one or more detection devices in a vicinity of the alarm condition, determining that a first subset of candidate exit locations are ineffective locations based on the first subset of candidate exit locations and the nature of the alarm condition, determining that a second subset of candidate exit locations are effective locations based on the second subset of candidate exit locations and the nature of the alarm condition, and identifying at least one of the second subset of candidate exit locations as the exit location.

In an additional or alternative aspect, the system and method may determine the nature of the alarm condition that triggered the alarm notification by one or any combination of, determining that a heat value recorded by a heat sensor is above a threshold heat value, determining that a pressure value recorded by a pressure sensor is above a threshold pressure value, determining that a light intensity recorded by a light sensor is above a threshold light intensity, determining that a noise value recorded by a microphone is above a threshold noise value, determining that a smoke density recorded by a smoke sensor is above a threshold smoke density value.

In an additional or alternative aspect, the system and method may determine the egress path by determining a set of candidate egress paths between the alarm condition location and each of the candidate exit locations, determining a first subset of candidate egress paths from the set of candidate egress paths as being ineffective egress paths, wherein the ineffective egress paths include the alarm condition location or include an area in the vicinity of the alarm condition location, determining a second subset of candidate egress paths from the set of candidate egress paths as being effective egress paths, and identifying at least one of the second subset of candidate egress paths as the egress path.

In an additional or alternative aspect, the system and method may transmit the plurality of commands to the plurality of notification devices by transmitting a set of visual output commands to a set of visual notification devices to trigger a coordinated visual output that indicates the egress path, and transmitting a set of audible output commands to a set of audible notification devices to trigger the audible outputs.

In an additional or alternative aspect, the system and method may transmit the set of visual commands to the set of visual notification devices by transmitting to a set of building lighting devices different from the plurality of notification devices.

In an additional or alternative aspect, the system and method may transmit the plurality of commands to trigger output of the egress notification in the coordinated pattern with the coordinated pattern as a pattern that indicates directional information to identify the egress path.

In an additional or alternative aspect, the system and method may transmit the plurality of commands to trigger output of the egress notification in the coordinated pattern with the coordinated pattern as a pattern to simulate the Doppler effect to indicate directional information.

BRIEF DESCRIPTION OF THE DRAWINGS

By way of example, specific embodiments of the disclosed system (computer device) and the method will now be described, with reference to the accompanying drawings, in which.

DETAILED DESCRIPTION

As discussed above, improvements are desired in existing emergency notification systems. To this end, a system (computer device) and a method for emergency notifications in accordance with the present disclosure will now be described more fully hereinafter with reference to the accompanying drawings. In some examples, the system and method may be used to provide directional emergency notifications to occupants with visual or hearing impairment who may have difficulty locating the proper exit. The emergency notification system of the present disclosure can overcome such issues by using audio/visual notification devices, which are coupled to a computer device.

In the event of an emergency, depending on the type of the emergency, a nearest exit to an occupant may not be the safest exit to escape for the emergency. For example, if there is a fire or explosion near an exit close to an office area, and due to smoke, the fire or explosion and the damage caused by the fire/explosion may not be visible to the occupants. In such a situation, the occupants may rush towards the exit close to the office area (which is also close to the fire/explosion). Such an action may be severely hazardous and life-threatening to the occupants.

The emergency notification system of the present disclosure takes into consideration that a nearest exit for occupants to escape may not be the safest exit. The emergency notification system determines an exit and indicates a path to the exit based on the available exits, the type of emergency event, the available paths to the exits, etc.

The emergency notification system of the present disclosure can also guide individuals towards the exit by using one or more audio/visual notifications to highlight the path to the exit, or the egress path. The emergency notification system may avoid the need for occupants to locate the exit, and a pattern indicated by one or more notification devices may guide the occupants through the egress path to the exit. The pattern indicated by the notification devices could be effective even with highly dense smoke or with an occupant suffering from visual or hearing impairment.

The system and method for communicating an emergency notification may be implemented for virtually any type of sound based notification systems (for example sirens, audio tones, automated (pre-recorded) announcements, manual (voice) announcements, etc.) and/or visual notification systems (strobes, Light Emitting Diodes (LEDs), Liquid Crystal Displays (LCDs), etc.) The system and method may be utilized for different kinds of buildings (e.g., auditoriums, hospitals, office spaces, etc.). The system and method may also be used for one or more open areas or in combination of open spaces and closed buildings.

Figure 1:
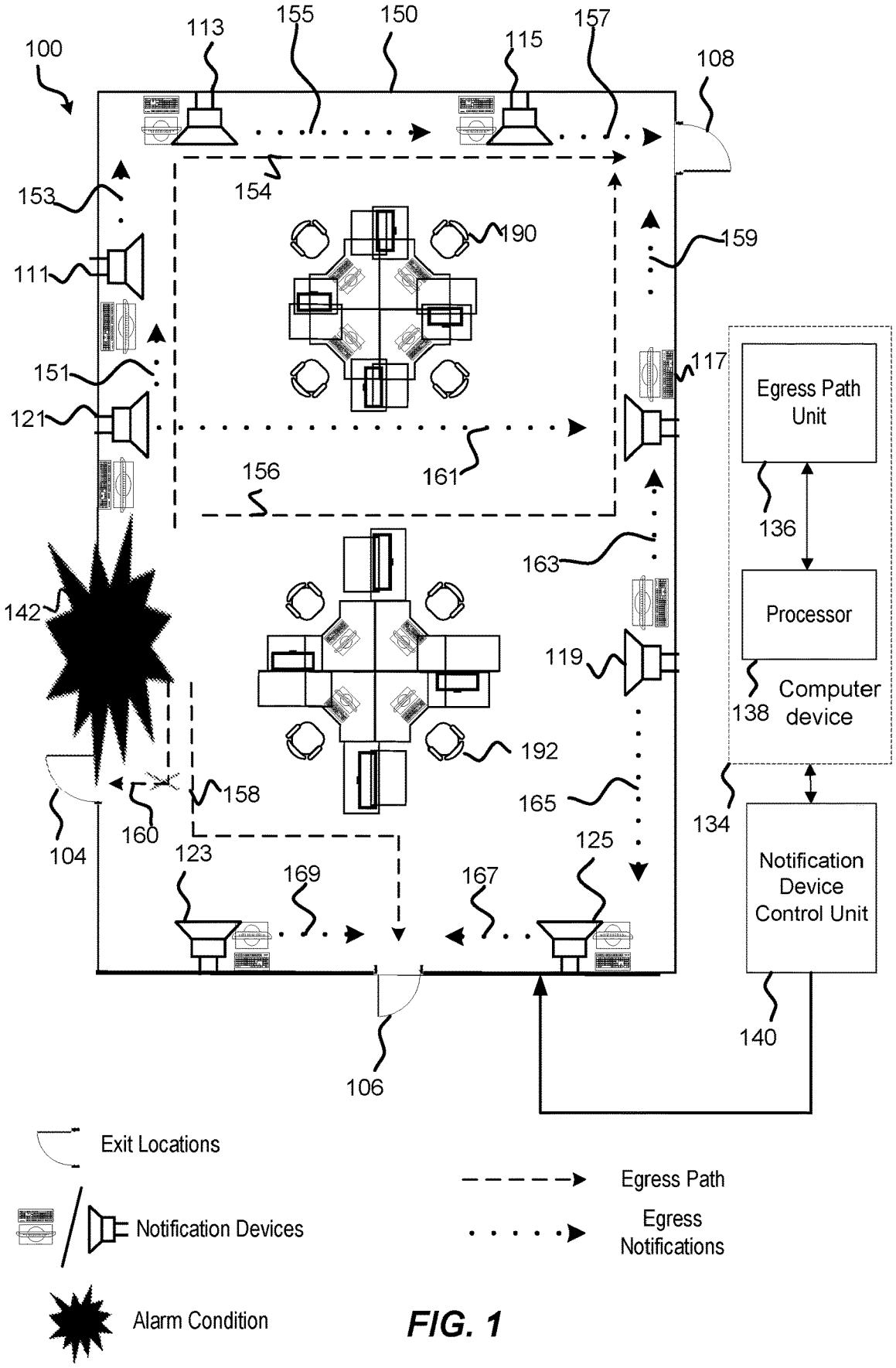
FIG. 1 is a block diagram of an example of an emergency notification system with a computer device to configure the emergency notification system to indicate an egress path based on an alarm condition.

FIG. 1 is a block diagram of an example emergency notification system 100 with a computer device 134 to communicate emergency notifications to occupants of a building 150. The building 150 is not limited to being a closed building but can be an open space, or any combination of open and/or closed spaces. In the example of FIG. 1, the building 150 includes office spaces 190 and 192. The emergency notification system 100 includes notification devices 111, 113, 115, 117, 119, 121, 123 and 125 for outputting a notification. The notification devices 111, 113, 115, 117, 119, 121, 123 and 125 may be any kind of sound based notification devices (including speakers, sirens, PAS (Public Address System) devices, fire alarms, etc.) and/or visual notification devices (e.g., building lighting devices such as light bulbs, strobes, LEDs, LCDs, etc.) that may be used to notify the occupants of the building 150 to exit from one of the exits 104, 106 and 108. The notification devices 111, 113, 115, 117, 119, 121, 123 and 125 may be communicatively coupled to a notification device control unit 140, such as via a wired or wireless communication link. The notification device control unit 140 may be communicatively coupled to the computer device 134 (and also to a processor 138 of the computer device 134), such as via a wired or wireless communication link or direct communication interface. The processor 138 may be communicatively coupled to an egress path unit 136 that may detect an alarm condition 142 sensed by one or more detection devices (e.g., heat sensors, pressure sensors, light sensors, smoke sensors, noise sensors, seismographs, vibration meter, etc.), determine one or more egress paths toward an exit, and generate controls signals to trigger the notification devices to provide an output that indicates the one or more egress paths.

For the purpose of simplicity, the detection devices in FIG. 1 are not labelled and described, however, one or more detection devices of each type (as described in examples above) may be present throughout the building 150 to detect one or more alarm conditions. The egress path unit 136 may detect the alarm condition 142 and determine the location of the alarm condition 142 based on the location of the detection devices. For example, the egress path unit 136 may determine the location of the alarm condition 142 based on receiving an alarm notification from a detection device, and the location of the respective detection device stored in a memory of the computer device 134. The egress path unit 136 may determine one or more exit locations from one of the exits 104, 106 and 108 to avoid the alarm condition 142. The egress path unit 136 may also determine egress paths 154, 156 and 158 (as illustrated by dashed lines in FIG. 1) to avoid the alarm condition 142 based on a location of the alarm condition 142 and the shortest distance path between the alarm condition 142 and the exits 106 and 108 to avoid the alarm condition 142. The egress path unit 136 may communicate the egress paths 154, 156 and 158 to the processor 138, and the processor 138 may issue instructions for the notification device control unit 140 to trigger output of egress notifications in a coordinated pattern to identify the egress paths 154, 156 and 158 at least a subset of the notification devices 111, 113, 115, 117, 119, 121, 123 and 125.

In one example, as illustrated in FIG. 1, the alarm condition 142 occurs in the building 150 in an area between the notification device 121 and the exit 104. For example, the alarm condition 142 may be a fire, a collapse of building equipment, a sudden noise, a sudden change in temperature in the respective area, etc. The alarm condition 142 is detected by one or more detection devices in the vicinity of the alarm condition 142. The detection device(s) may send an alarm notification about the alarm condition 142 to the egress path unit 136. The egress path unit 136 upon receiving the alarm notification may determine an alarm condition location, i.e., the location at which the alarm condition 142 has occurred. In one implementation, the egress path unit 136 may determine the alarm condition location based on the location of the detection device(s). For example, the computer device 134 may store a location map of the building 150 and each of the detection devices in the building 150. The egress path unit 136 upon receiving the alarm notification, may identify the detection device sending the alarm notification and based on the location map, the egress path unit 136 may determine the location of the detection device sending the alarm notification and in turn the alarm condition location.

Upon determining the alarm condition location, the egress path unit 136 may determine an exit location to avoid the alarm condition. For example, the egress path unit 136 may determine that candidate exit locations from the building 150 are the exits 104, 106 and 108. The egress path unit 136 may further determine the nature of the alarm condition. For example, based on determining that the detection device sending the alarm notification was a heat sensor, the egress path unit 136 may determine that the alarm condition is a fire. Similarly, based on determining that the detection device sending the alarm notification was a vibration meter, the egress path unit 136 may determine that the alarm condition was a collapse of building equipment. The egress path unit 136 may then determine the exit 104 as a first set of candidate exit locations which are ineffective locations as they are in the vicinity of the alarm condition location. The egress path unit 136 may also determine the exits 108 and 106 as a second set of candidate exit locations which are effective locations as they are sufficiently distant from the alarm condition location. The egress path unit 136 may then determine the exits 106 and 108 as the exit locations.

Further, the egress path unit 136 may determine a set of candidate egress paths 154, 156, 158 and 160 between the alarm condition location and each of the candidate exit locations. For example, the egress path unit 136 may determine the set of candidate egress paths 154, 156, 158 and 160 as the shortest distance egress paths between the alarm condition location and each of the candidate exit locations (i.e., the exits 104, 106 and 108). The egress path unit 136 may then determine a first subset of candidate egress paths from the set of candidate egress paths 154, 156, 158 and 160 as being ineffective egress paths. For example, the first subset of candidate egress paths may include the egress path 160 between the alarm condition location and the exit 104, since occupants in the vicinity of the alarm condition location would not be able to exit through the exit 104 without avoiding the alarm condition 142. The egress path unit 136 may determine a second subset of candidate egress paths from the set of candidate egress paths 154, 156, 158 and 160 as being effective egress paths. For example, the second subset of candidate egress paths may include the egress paths 154 and 156 between the alarm condition location and the exit 108, and the egress path 160 between the alarm condition location and the exit 106, since occupants in the vicinity of the alarm condition location can safely exit through the exits 106 and 108 while avoiding the alarm condition 142. The egress path unit 136 may then identify at least one of the second subset of candidate egress paths as the egress path (i.e., the egress paths 154, 156 and 160 as described in the example of FIG. 1).

The egress path unit 136 may further determine the egress paths 154, 156 and 160 based on the distance of egress paths between the alarm condition location and the exits 106 and 108 in the building as well as the location of the alarm condition. For example, the egress path 158 to the exit 106 which includes the notification device 123 may be smaller than an egress path to the exit 106 which includes the notification devices 119 and 125 (not illustrated in FIG. 1 for simplicity). However, the egress path unit 136 may determine that the path including the notification device 123 is smaller in distance than the path including the devices 119 and 125 and therefore the egress path unit 136 may determine the egress path 158 from the alarm condition location to the exit 106 which includes the notification device 123 as one of the egress paths.

The egress path unit 136 may transmit the information about the respective egress paths 154, 156 and 158 to the processor 138. The processor 138 may send instructions to the notification device control unit 140 to trigger output of egress notifications 151, 153, 155, 157, 159, 161, 163, 165, 167 and 169 (as illustrated in FIG. 1 with dotted arrows) at the notification devices 111, 113, 115, 117, 119, 121, 123 and 125 in a coordinated pattern to identify and highlight the egress paths 154, 156 and 158. For example, the notification device control unit 140 may trigger output of the egress notifications 151 and 161 from the notification device 121, the egress notification 153 from the notification device 111, the egress notification 155 from the notification device 113, the egress notification 157 from the notification device 115 in a coordinated pattern such as through audio instructions, blinking of LED lights, etc. (e.g., LED lights synchronized in time so that the egress notification from the notification device 111 is triggered immediately in time after the egress notification from the notification device 121) to highlight the egress path 154. Similarly, the notification device control unit 140 may trigger output of the egress notification 161 from the notification device 121, the egress notification 159 from the notification device 117 to highlight the egress path 156. Also, the notification device control unit 140 may trigger output of the egress notification 169 from the notification device 123 to highlight the egress path 158. Further, the notification device control unit 140 may trigger egress notifications 163 and 165 from the notification device 119 and the egress notification 167 from the notification device 125 to indicate to the occupants of the building 150 to exit from the building 150. The egress notification 163 may be coordinated with the egress notification 159 to indicate to the occupants to exit the building 150 through the exit 108. The egress notification 165 and 167 may be coordinated to indicate to the occupants to exit the building 150 through the exit 106. Although egress paths for the egress notifications 163, 165 and 167 are not shown in FIG. 1, the notification device control unit 140 may trigger the egress notifications 163, 165 and 167 based on the alarm condition 142 occurring anywhere within the building 150.

Figure 2:
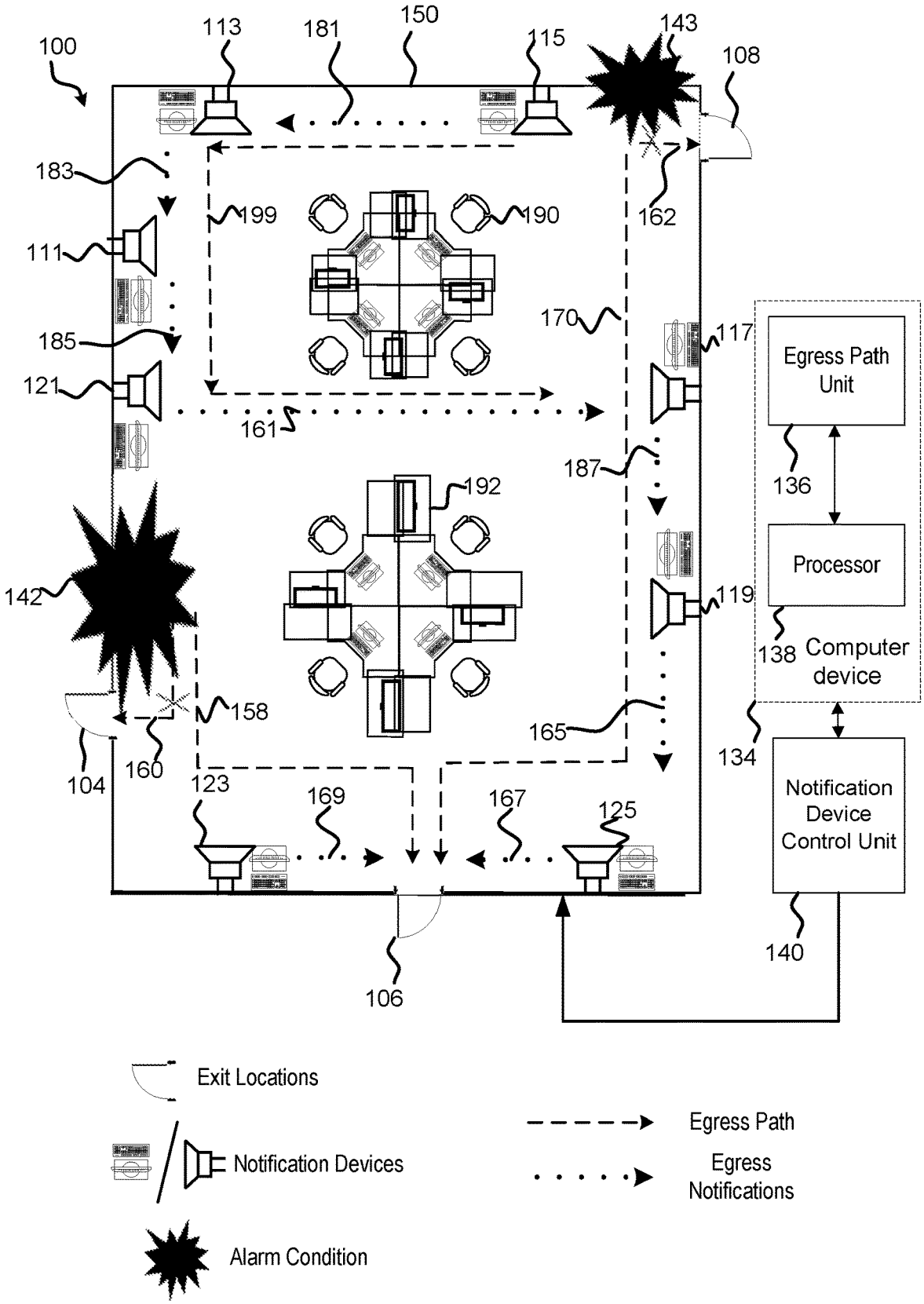
FIG. 2 is a block diagram of another example of an emergency notification system, similar to FIG. 1, including an indication of one or more different egress paths based on a second alarm condition.

FIG. 2 is another example block diagram of the emergency notification system 100, as described above with reference to FIG. 1 with a computer device 134 to communicate emergency notifications to occupants of the building 150 with two alarm conditions 142 and 143. The alarm conditions 142 and 143 may be subsequent or simultaneous. In one example, the alarm condition 143 may occur after the alarm condition 142.

In one example, as illustrated in FIG. 2, the alarm conditions 142 and 143 occur subsequently in the building 150. The alarm condition 142 may occur in an area between the notification device 121 and the exit 104. For example, the alarm conditions 142 and 143 may be one or a combination of a fire, a collapse of building equipment, a sudden noise, a sudden change in temperature in the respective area, etc. The alarm conditions 142 and 143 are detected by one or more detection devices in the vicinity of the alarm conditions 142 and 143. The detection devices may send an alarm notification about the alarm conditions 142 and 143 to the egress path unit 136. The egress path unit 136 upon receiving the alarm notification 142 from the respective detection device may determine a first alarm condition location at which the alarm condition 142 has occurred. Upon determining the first alarm condition location, the egress path unit 136 may determine an exit location to avoid the alarm condition. For example, the egress path unit 136 determine the exits 106 and 108 as the exit locations, as described above in FIG. 1. The egress path unit 136 may also determine a first set of egress paths from each of the notification devices 111, 113, 115, 117, 119, 121, 123 and 125 to the exits 106 and 108 as described above with reference to FIG. 1.

Subsequently, the alarm condition 143 may occur in an area between the notification device 115 and the exit 108. The egress path unit 136 may determine a second alarm condition location at which the alarm condition 143 has occurred using a similar technique as used for determining the first alarm condition location. Upon determining the second alarm condition location, the egress path unit 136 may determine an exit location to avoid both the first and the second alarm conditions. For example, the egress path unit 136 may determine that only the exit 106 is an exit location that can be used by occupants of the building 150 to avoid both the first and the second alarm conditions. The egress path unit 136 may further determine a second set of egress paths 158, 199 and 170 between the first and second alarm condition locations and the exit 106 that include each of the notification devices 111, 113, 115, 117, 119, 121, 123 and 125, using a similar technique as used for determining the first set of egress paths as discussed above and in FIG. 1. As illustrated in FIG. 2, the egress path unit 136 may modify egress paths in the building 150 based on the occurrence of the alarm condition 143. For example, the egress path unit 136 may determine the egress paths 170 and 199 between the alarm condition location of the alarm condition 143 and the exit 106, and the egress path 158 (as described above with reference to FIG. 1). Based on the occurrence of the alarm condition 143, the egress path unit 136 may modify the egress path 156 (as illustrated in FIG. 1) to the egress path 170 (based on determining the exit 108 as an ineffective exit location using a similar technique as described above with reference to FIG. 1). Similarly, the egress path unit 136 may determine that the egress path 156 (as described above with reference to FIG. 1) is an ineffective egress path (using a similar technique as described above with reference to FIG. 1), and the ineffective egress path through the exit 108 in FIG. 2 is shown as an egress path 162. In the example of FIG. 2, the egress path unit 136 may determine the egress paths 160 and 162 as a first set of egress paths which are ineffective egress paths (using a similar technique as described above with reference to FIG. 1). The egress path unit 136 may determine the egress paths 158, 199 and 170 as a second set of egress paths which are effective egress paths (using a similar technique as described above with reference to FIG. 1).

The egress path unit 136 may then transmit the information about the second set of egress paths to the processor 138. The processor 138 may send instructions to the notification device control unit 140 to trigger output of egress notifications 181, 183, 185, 161, 163, 165, 167 and 169 (as illustrated in FIG. 2 with dotted arrows) at the notification devices 111, 113, 115, 117, 119, 121, 123 and 125 in a coordinated pattern to identify and highlight the egress paths 158, 199 and 170. Egress notifications 151, 153, 155, 157 and 159 (as described above with reference to FIG. 1) are not triggered in FIG. 2, as exit 108 is determined by the egress path unit 136 as an ineffective exit location. Instead egress notifications 181, 183, 185, 161 and 187 are triggered which may notify the occupants of the building 150 to exit through the exit 106. The egress notifications 161, 165, 167 and 169 are similar to the egress notifications in FIG. 1, except that they may be coordinated with the egress notifications 181, 183, 185 and 187 instead of being coordinated with the egress notifications 151, 153, 155, 157 and 159 in FIG. 1.

For example, the notification device control unit 140 may trigger output of the egress notification 187 from the notification device 117, the egress notification 165 from the notification device 119 and the egress notification 167 from the notification device 125 in a coordinated pattern (as described above with reference to FIG. 1) to highlight the egress path 170. Similarly, the notification device control unit 140 may trigger the egress notification 169 from the notification device 123 to highlight the egress path 158. Also, the notification device control unit 140 may trigger the egress notifications 181 from the notification device 115, the egress notifications 183 from the notification device 111, the egress notification 185 from the notification device 111 and the egress notification 161 from the notification device 121 to highlight the egress path 199. The egress notifications 181, 183, 185 and 161 may be coordinated with the egress notifications 187, 165 and 167 to indicate to the occupants to exit the building 150 through the exit 106.

In another example, alarm conditions may occur in vicinity of each of the exits 104, 106 and 108 (not labelled and described in FIG. 2 for simplicity, but such an alarm condition could be an alarm condition similar to the alarm conditions 142 and 143 in the vicinity of exit 106). The egress path unit 136 may perform the functions of receiving alarm notifications from detection devices in the building 150, determining alarm condition locations, determining an exit location(s) and egress path(s) as described above. However, based on the alarm conditions in the vicinity of each of the exits 104, 106 and 108, and the nature of the respective alarm conditions, the egress path unit 136 may determine that there are no egress paths that can avoid the alarm conditions. Based on determining the non-availability of egress paths, the egress path unit 136 may transmit the information of non-availability of egress paths to the processor 138, and the processor 138 may send instructions to the notification device control unit 140 to trigger output of non-directional egress notifications from each of the notification devices 111, 113, 115, 117, 119, 121, 123 and 125. For example, the non-directional egress notifications may signal to the occupants of the building 150 that the occupants should exit from whichever exit is available or visible to them.

Figure 3:
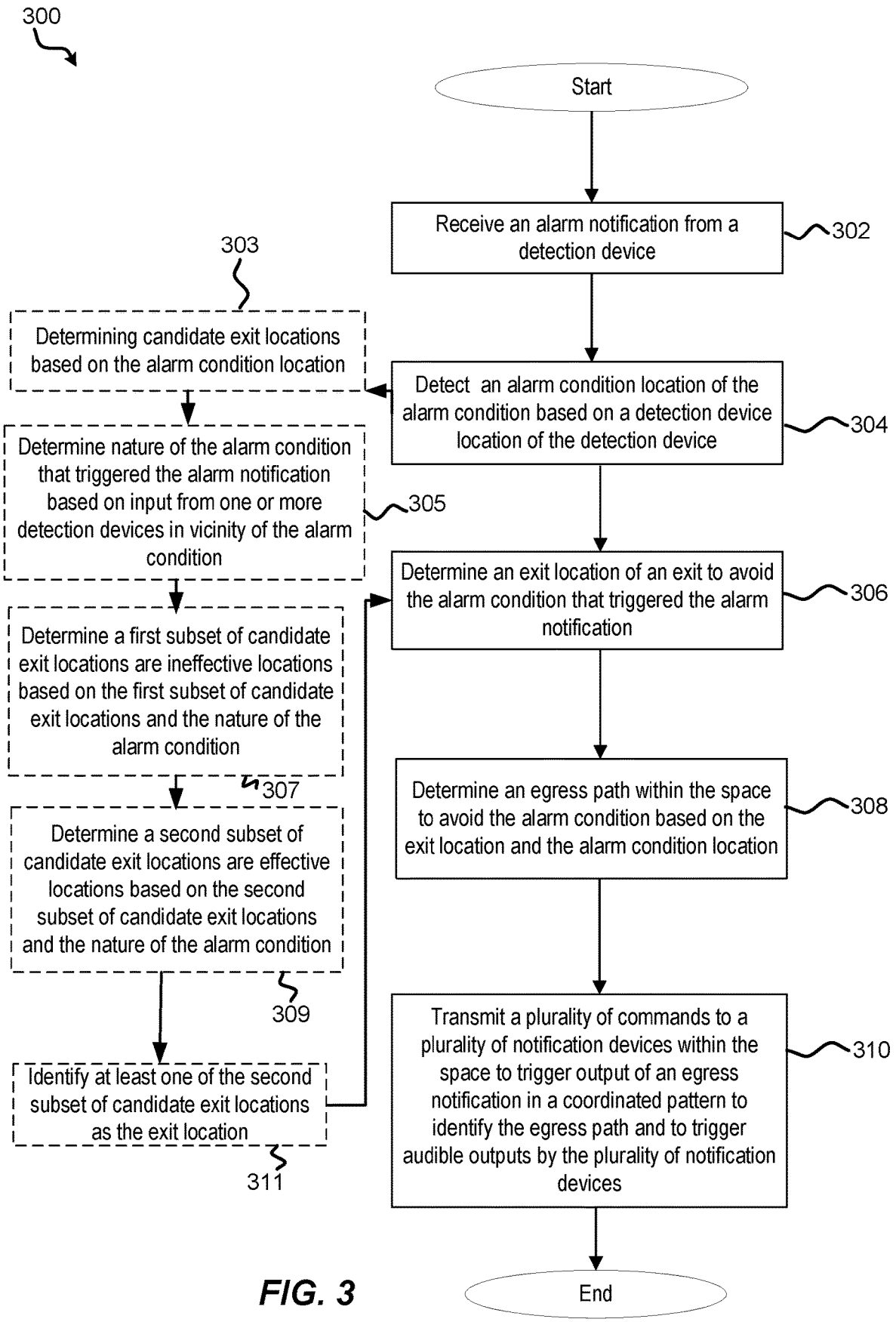
FIG. 3 is a flow diagram for an example method for operating an emergency notification system.

FIG. 3 includes the exemplary method 300 and includes various actions that may be performed by one or more components of the emergency notification system 100, as described above with reference to FIG. 1.

At block 302, the method 300 includes receiving an alarm notification from a detection device. For example, the egress path unit 136 receives alarm notifications from one or more detection devices in the building 150. In one implementation, the egress path unit 136 may receive the alarm notifications as one or a combination of a heat value recorded by a heat sensor being above a threshold heat value, a pressure value recorded by a pressure sensor being above a threshold pressure value, a light intensity recorded by a light sensor being above a threshold light intensity, a noise value recorded by a microphone being above a threshold noise value, a pressure value recorded by a pressure sensor being above a threshold pressure value, a smoke density recorded by a smoke sensor being above a threshold smoke density value etc.

At block 304, the method 300 includes detecting an alarm condition location of the alarm condition based on a detection device location of the detection device. In one implementation, the egress path unit 136 may determine the alarm condition location based on the location of the detection device(s) sending the alarm notification. For example, egress path unit 136 may read the location of the detection device (s) from a table (stored in a memory of the computer device 134) specifying location of each of the detection devices in the building 150. In another implementation, the detection device(s) sending the alarm notification may send their respective location(s) to the egress path unit, for e.g., coordinates of the respective detection device(s) sending the alarm notification may be included in the alarm notification.

At block 306, the method 300 includes determining an exit location of an exit to avoid the alarm condition that triggered the alarm notification. In one implementation, the egress path unit 136 may determine the exit location of an exit to avoid the alarm condition that triggered the alarm notification. For example, the egress path unit 136 may determine the exit locations of the exits 106 and 108 (using the technique as described above with reference to FIG. 1) to avoid the alarm condition 142. The egress path unit 136 may determine that the alarm condition location of the alarm condition 142 is at a sufficient distance through the exits 106 and 108 to pose any hazards to occupants exiting through the exits 106 and 108.

In an alternate example, the method 300 may include performing the operations of blocks 303-311 after performing the operation at block 304 and before performing the operation at block 306, as described below.

At block, 303, the method 300 includes determining candidate exit locations exit locations based on the alarm condition location. In one implementation, the egress path unit 136 may determine the exits 104, 106 and 108 as the candidate exit locations based on the alarm condition location of the alarm condition 142 in the building 150. For example, the egress path unit 136 may determine that occupants in the area including exits 104, 106 and 108 may be at risk due to hazards posed by the alarm condition 142.

At block 305, the method 300 includes determining nature of the alarm condition that triggered the alarm notification based on input from one or more detection devices in vicinity of the alarm condition. In one implementation, the egress path unit 136 may determine the nature of the alarm condition 142 that triggered the alarm notification. For example, the egress path unit 136 may determine that the nature of the alarm condition 142 is a fire based on determining that a heat value recorded by heat sensors in the vicinity of the alarm condition location is above a threshold heat value. Similarly, the egress path unit 136 may determine that the nature of the alarm condition 142 is a collapse of building equipment based on determining that a pressure value recorded by pressure sensors in the vicinity of the alarm condition location is above a threshold pressure value, etc.

At block 307, the method 300 includes determining a first subset of candidate exit locations are ineffective locations based on the first subset of candidate exit locations and the nature of the alarm condition. In one implementation, the egress path unit 136 may determine that the first subset of candidate exit locations which includes the exit 104 are ineffective locations based on the first subset of candidate exit locations, and the nature of the alarm condition 142 as determined above at block 305. For example, the egress path unit 136 may determine the nature of the alarm condition 142 as a fire, and the first subset of candidate exit locations as ineffective locations, since the exit 104 is in vicinity of the fire and the flames of the fire pose hazards to the occupants exiting through the exit 104.

At block 309, the method 300 includes determining a second subset of candidate exit locations are effective locations based on the second subset of candidate exit locations and the nature of the alarm condition. In one implementation, the egress path unit 136 may determine that the second subset of candidate exit locations which includes the exits 106 and 108 are effective locations based on the second subset of candidate exit locations 106 and 108, and the nature of the alarm condition 142 as determined above at block 305. For example, the egress path unit 136 may determine the nature of the alarm condition 142 as a fire, and the second subset of candidate exit locations as effective locations, since the exits 106 and 108 are at a safe distance from the fire, and the flames of the fire do not pose hazards to the occupants exiting through the exits 106 and 108.

At block 311, the method 300 includes identifying at least one of the second subset of candidate exit locations as the exit location. In one implementation, the egress path unit 136 may identify at least one of the exits 106 and 108 as the exit location. For example, the egress path unit 136 may determine the exit 106, or the exit 108, or both as the exit locations based on the size, width, height, distance from the alarm condition location, etc., of the exits 106 and 108.

At block 308, the method 300 includes determining an egress path within the space to avoid the alarm condition based on the exit location and the alarm condition location. In one implementation, the egress path unit 136, may determine one or more egress paths to avoid the alarm condition 142 based on the exit location (as determined above at block 311 or 306), and the alarm condition location. For example, the egress path unit 136 may determine the nature of the alarm condition as a fire, and the egress path unit 136 may determine egress paths 154, 156 and 158 as described above with reference to FIG. 1.

At block 310, the method 300 includes transmitting a plurality of commands to a plurality of notification devices within the space to trigger output of an egress notification in a coordinated pattern to identify the egress path and to trigger audible outputs by the plurality of notification devices. In one implementation, the processor 138 may send instructions to the notification device control unit 140 to transmit a plurality of commands to each of the notification devices 111, 113, 115, 117, 119, 121, 123 and 125. For example, the instructions sent by the processor 138 may instructions to trigger output of the egress notifications 151, 153, 155, 157, 159, 161, 163, 165, 167 and 169 as described above with reference to FIG. 1. The notification device control unit 140 may transmit a plurality of commands to the notification devices 121, 111, 113 and 115 to identify the egress path 154. Similarly, the notification device control unit 140 may transmit a plurality of commands to the notification devices 121 and 117 to identify the egress path 156. The notification device control unit 140 may further transmit a plurality of commands to the notification devices 123 to identify the egress path 158. The notification device control unit 140 may transmit a plurality of commands to the notification devices 119 and 125 as described above with reference to FIG. 1, For example, the notification devices 121, 111, 113, 115 and 117 may announce to the occupants to exit the building 150 through the exit 108. The notification devices 121, 111, 113, 115 and 117 may also notify the occupants to exit through the exit 108 by displaying directions on an LCD. For example, an LCD at the notification device 121 may display arrows pointing towards the notification device 111, an LCD at the notification device 111 may display arrows pointing towards the notification device 113, an LCD at the notification device 113 may display arrows pointing towards the notification device 115 and an LCD at the notification device 115 may display arrows pointing towards exit 108. Further, the notification device control unit 140 may transmit commands to each of the notification devices 119, 123 and 125 to trigger output of egress notifications to notify the occupants to exit through the exit 106. The notification devices 119, 123 and 125 may signal the occupants (through egress notifications) to exit through the exit 106 by a combination of one or more audio and visual notifications in a similar manner as described above with reference to the notification devices 121, 111, 113, 115 and 117. For example, the notification devices 119, 123 and 125 may announce to the occupants to exit the building 150 through the exit 106. Further, the notification devices 121 and 123 may also notify the occupants to exit through the exit 106 by displaying egress notifications in a coordinated pattern. For example, an LED of the notification device 119 may light up first and an LED of the notification device 125 may light up next to notify the occupants how they should move (i.e., from the notification device 119 in the direction of the notification device 125) in order to exit through the exit 106.

In another implementation, the notification devices 121, 111, 113, 115 and 117 may signal to the occupants to exit through the exit 108 by triggering audible outputs for egress notifications in a coordinated pattern. For example, the notification devices 121, 111, 113, 115 and 117 may output beeps in a high volume and a low volume to indicate to the occupants, the direction the occupants should move in (e.g., to move in the direction from a low volume beep to a high volume beep). Such audible outputs for egress notifications having directional information may be especially useful for visually impaired occupants, as well as all occupants in special circumstances (e.g., the alarm condition being smoky environment). As described above, the output of the notification devices 121, 111, 113, 115 and 117 may be controlled to simulate a Doppler Effect for triggering audible outputs for egress notifications in a coordinated pattern to provide directional information to the occupants to exit through the exit 108. Similar techniques may be utilized by the notification devices 119, 123 and 125.

Figure 4:
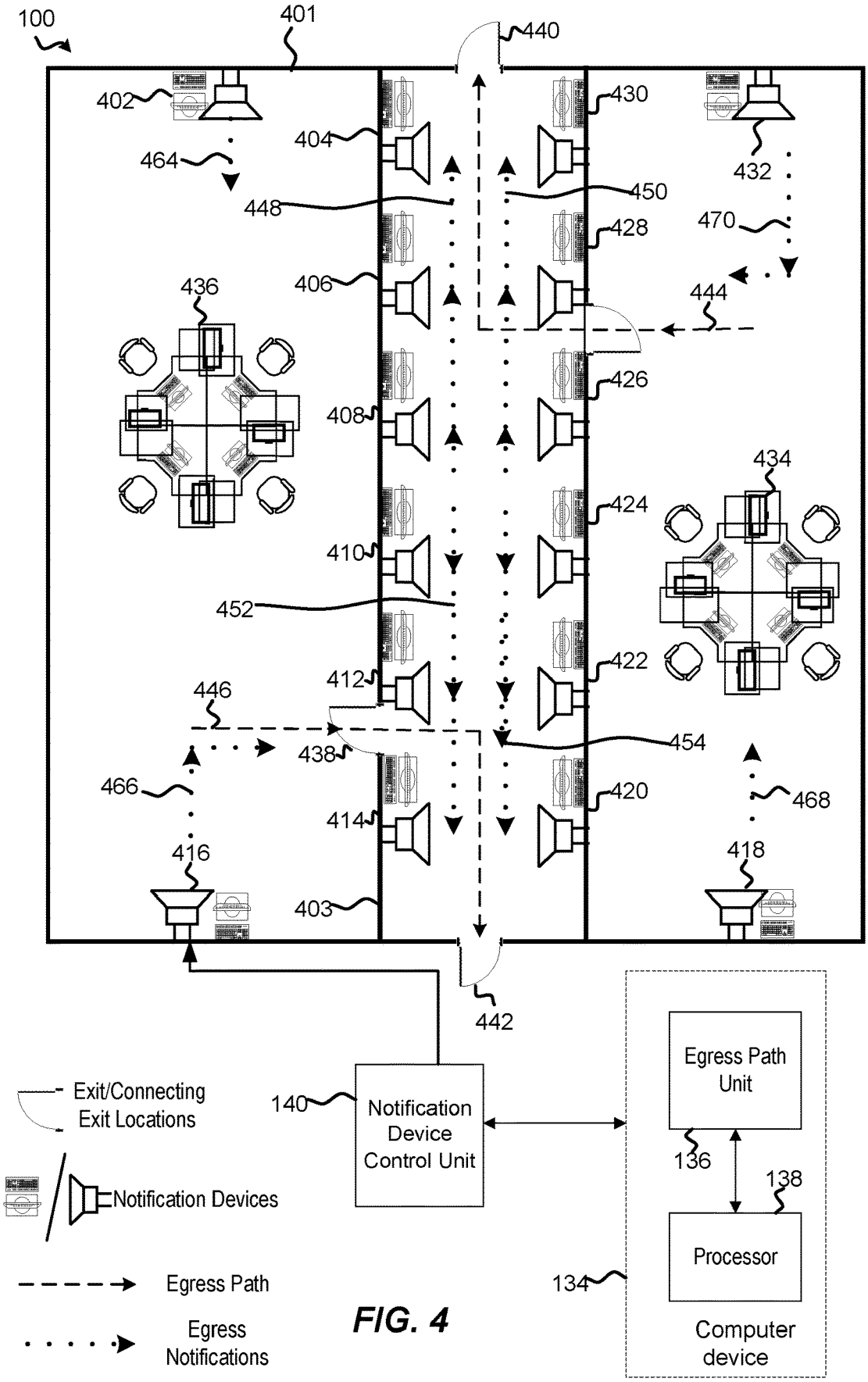
FIG. 4 is a block diagram of another example of an emergency notification system, similar to FIG. 1, including includes features to notify occupants of a floor in a building about a general evacuation of the floor due to an alarm condition at another floor in the building.

FIG. 4 is another example block diagram of the emergency notification system 100, and includes features to notify occupants of a floor 401 in a building (e.g., the building 150 as described above with reference to FIG. 1) about a general evacuation of the floor 401 due to an alarm condition at another floor in the building (for example, an alarm condition 560 as described below with reference to FIG. 5). In the example of FIG. 4, the floor 401 includes office spaces 434, 436 and an exit hallway 403. The office spaces 434 and 436 are connected to an exit hallway 403 via connecting exits 438 and 444, respectively. The connecting exits 438 and 444 may be nodal points that may be specific locations on the floor 401 from which determination of egress paths is desirable. The emergency notification system 100 includes notification devices 402, 404, 406, 408, 410, 412, 414, 416, 418, 420, 422, 424, 426, 428, 430 and 432 for outputting a notification. The notification devices 402, 404, 406, 408, 410, 412, 414, 416, 418, 420, 422, 424, 426, 428, 430 and 432 are similar to the notification devices 111, 113, 115, 117, 119, 121, 123 and 125 as described above with reference to FIG. 1 and may be used to notify the occupants of the floor to exit from one of the exits 440 and 442. The notification devices 402, 404, 406, 408, 410, 412, 414, 416, 418, 420, 422, 424, 426, 428, 430 and 432 may be communicatively coupled to a notification device control unit 140, such as via a wired or wireless communication link, as described above with reference to FIG. 1. The notification device control unit 140 may be communicatively coupled to the computer device 134 (and also to a processor 138 of the computer device 134), such as via a wired or wireless communication link or direct communication interface, as described above with reference to FIG. 1. The processor 138 may be communicatively coupled to an egress path unit 136 that may detect an alarm condition 142 sensed by one or more detection devices (e.g., heat sensors, pressure sensors, light sensors, smoke sensors, noise sensors, seismographs, vibration meter, etc.), determine one or more egress paths toward an exit, and generate controls signals to trigger the notification devices to provide an output that indicates the one or more egress paths, as described above with reference to FIG. 1.

For the purpose of simplicity, the detection devices in FIG. 4 are not labelled and described, however, one or more detection devices of each type (as described in examples above) may be present throughout the floor 401 to detect one or more alarm conditions. The egress path unit 136 may receive information about an alarm condition on another floor (i.e., a floor different from the floor 401) and to evacuate the floor 401 in absence of an alarm condition on the floor 401. The egress path unit 136 may determine exit locations as the exits 440 and 442 to exit from the floor 401. The egress path unit 136 may also determine egress paths 444 and 446 (as illustrated by dashed lines in FIG. 4) to exit from the exits 440 and 442, respectively. The egress path unit 136 may communicate the egress paths 444 and 446 to the processor 138, and the processor 138 may issue instructions for the notification device control unit 140 to trigger output of egress notification in a coordinated pattern to identify the egress path at least a subset of the notification devices 402, 404, 406, 408, 410, 412, 414, 416, 418, 420, 422, 424, 426, 428, 430 and 432.

The egress path unit 136 may determine the egress paths 444 and 446 based on the nearest exit to the connecting exits 438 and 444. The egress path unit 136 may determine the exit 442 as the nearest exit to the connecting exit 438, and the egress path 446 may determine the exit 440 as the nearest exit to the connecting exit 444. The egress path unit 136 may transmit the information about the respective egress paths 444 and 446 to the processor 138. The processor 138 may send instructions to the notification device control unit 140 to trigger output of egress notifications 448, 450, 452, 454, 464, 466, 468 and 470 (as illustrated in FIG. 4 with dotted arrows) at the notification devices 402, 404, 406, 408, 410, 412, 414, 416, 418, 420, 422, 424, 426, 428, 430 and 432 in a coordinated pattern to identify and highlight the egress paths 444 and 446. For example, the notification device control unit 140 may trigger output of the egress notifications 448 from the notification devices 404, 406 and 408 in a coordinated pattern such as through audio instructions, blinking of LED lights, etc. (e.g., LED lights synchronized in time so that the egress notification from the notification device 406 is triggered immediately in time after the egress notification from the notification device 408, and the egress notification from the notification device 404 is triggered immediately in time after the egress notification from the notification device 406) to highlight the egress path 444. Similarly, the notification device control unit 140 may trigger output of the egress notifications 450, 468 and 470 from the notification devices 418, 426, 428, 430 and 432 to highlight the egress path 444. In a similar manner, the notification device control unit 140 may trigger output of the egress notifications 452, 464 and 466 from the notification devices 402, 410, 412, 414 and 416 to highlight the egress path 446. Also, the notification device control unit 140 may trigger output of the egress notification 454 from the notification devices 420, 422 and 424 to highlight the egress path 446.

Figure 5:
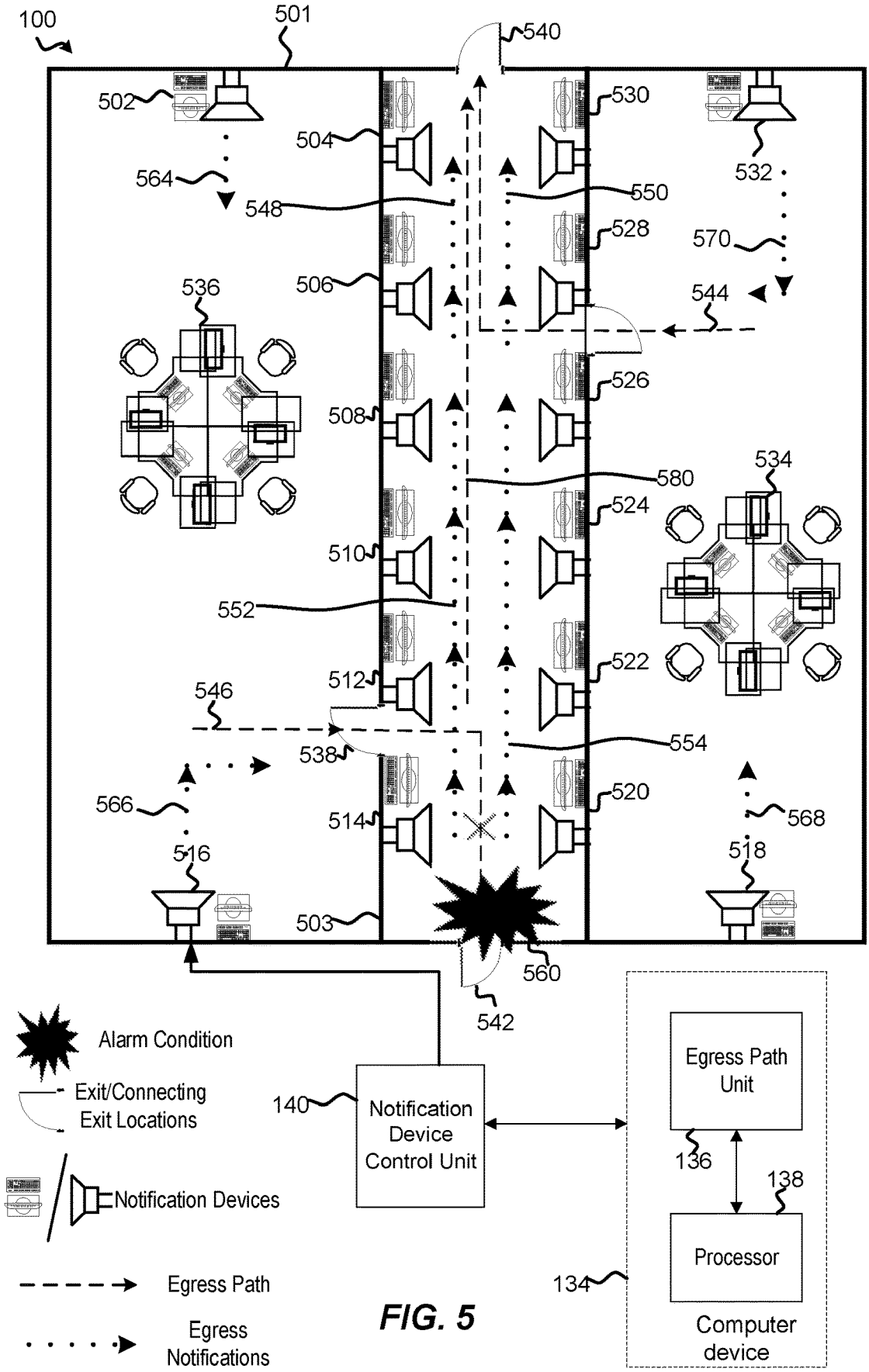
FIG. 5 is a block diagram of another example of an emergency notification system, similar to FIG. 1, including features to notify occupants of a floor in a building to evacuate the floor due to an alarm condition at the floor in the building.

FIG. 5 is another example block diagram of the emergency notification system 100, and includes features to notify occupants of a floor 501 in a building (e.g., the building 150 as described above with reference to FIG. 1) to evacuate the floor 501 due to an alarm condition 560 at the floor 501 in the building. In the example of FIG. 5, the floor 501 includes office spaces 534, 536 and an exit hallway 503. The office spaces 534 and 536 are connected to an exit hallway 503 via connecting exits 538 and 544, respectively. The connecting exits 538 and 544 may be nodal points that may be specific locations on the floor 501 from which determination of egress paths is desirable. The emergency notification system 100 includes notification devices 502, 504, 506, 508, 510, 512, 514, 516, 518, 520, 522, 524, 526, 528, 530 and 532 for outputting a notification. The notification devices 502, 504, 506, 508, 510, 512, 514, 516, 518, 520, 522, 524, 526, 528, 530 and 532 are similar to the notification devices 111, 113, 115, 117, 119, 121, 123 and 125 as described above with reference to FIG. 1 and may be used to notify the occupants of the floor to exit from one of the exits 540 and 542. The notification devices 502, 504, 506, 508, 510, 512, 514, 516, 518, 520, 522, 524, 526, 528, 530 and 532 may be communicatively coupled to a notification device control unit 140, such as via a wired or wireless communication link, as described above with reference to FIG. 1. The notification device control unit 140 may be communicatively coupled to the computer device 134 (and also to a processor 138 of the computer device 134), such as via a wired or wireless communication link or direct communication interface, as described above with reference to FIG. 1. The processor 138 may be communicatively coupled to an egress path unit 136 that may detect an alarm condition 560 sensed by one or more detection devices (e.g., heat sensors, pressure sensors, light sensors, smoke sensors, noise sensors, seismographs, vibration meter, etc.), determine one or more egress paths toward an exit, and generate controls signals to trigger the notification devices to provide an output that indicates the one or more egress paths, as described above with reference to FIG. 1.

For the purpose of simplicity, the detection devices in FIG. 5 are not labelled and described, however, one or more detection devices of each type (as described in examples above) may be present throughout the floor 501 to detect one or more alarm conditions. The egress path unit 136 may receive information about the alarm condition 560 and to evacuate the floor 501.

The egress path unit 136 may detect the alarm condition 560 and determine the location of the alarm condition 560 based on the location of the detection devices. For example, the egress path unit 136 may determine the location of the alarm condition 560 based on receiving an alarm notification from a detection device, and the location of the respective detection device stored in a memory of the computer device 134. The egress path unit 136 may determine one or more exit locations from one of the exits 540 and 542 to avoid the alarm condition 142. The egress path unit 136 may also determine egress paths 544 and 580 (as illustrated by dashed lines in FIG. 5) to avoid the alarm condition 560 based on a location of the alarm condition 560 and the exit locations. The egress path unit 136 may communicate the egress paths 580 to the processor 138, and the processor 138 may issue instructions for the notification device control unit 140 to trigger output of egress notification in a coordinated pattern to identify the egress paths 544 and 580 using at least a subset of the notification devices 502, 504, 506, 508, 510, 512, 514, 516, 518, 520, 522, 524, 526, 528, 530 and 532.

In one example, as illustrated in FIG. 5, the alarm condition 560 occurs on the floor 501 in an area between the notification devices 514, 520 and the exit 542. For example, the alarm condition 560 may be a fire, a collapse of building equipment, a sudden noise, a sudden change in temperature in the respective area, etc. The alarm condition 560 is detected by one or more detection devices in the vicinity of the alarm condition 560. The detection device(s) may send an alarm notification about the alarm condition 560 to the egress path unit 136. The egress path unit 136 upon receiving the alarm notification may determine an alarm condition location, i.e., the location at which the alarm condition 560 has occurred. In one implementation, the egress path unit 136 may determine the alarm condition location based on the location of the detection device(s) as described above with reference to FIG. 1.

Upon determining the alarm condition location, the egress path unit 136 may determine an exit location to avoid the alarm condition. For example, the egress path unit 136 may determine that candidate exit locations from the building 150 are the exits 540 and 542. The egress path unit 136 may further determine the nature of the alarm condition in a similar manner as described above with reference to FIG. 1. The egress path unit 136 may then determine the exit 542 as a first set of candidate exit locations which are ineffective locations as they are in the vicinity of the alarm condition location. The egress path unit 136 may also determine the exit 540 as a second set of candidate exit locations which are effective locations as they are sufficiently distant from the alarm condition location. The egress path unit 136 may then determine the exit 540 as the exit location.

Further, the egress path unit 136 may determine a set of candidate egress paths 544, 546 and 580 between the alarm condition location and each of the candidate exit locations. For example, the egress path unit 136 may determine candidate egress paths as the egress paths between the alarm condition location and each of the candidate exit locations (i.e., the exits 540 and 542). The egress path unit 136 may then determine a first subset of candidate egress paths from the set of candidate egress paths 544, 546 and 580 as being ineffective egress paths. For example, the first subset of candidate egress paths may include the egress path 546 since occupants would not be able to exit through the exit 542 without avoiding the alarm condition 560. The egress path unit 136 may determine a second subset of candidate egress paths from the set of candidate egress paths 544, 546 and 580 as being effective egress paths. For example, the second subset of candidate egress paths may include the egress paths 544 and 580 between the alarm condition location and the exit 540, since occupants in the vicinity of the alarm condition location can safely exit through the exit 540 while avoiding the alarm condition 560. The egress path unit 136 may then identify at least one of the second subset of candidate egress paths as the egress path (i.e., the egress paths 544 and 580). The egress path unit 136 may further determine the egress paths 544 and 580 based on the distance of egress paths between the alarm condition location and the exit 540 as well as the location of the alarm condition, in a similar manner as described above with reference to FIG. 1.

The egress path unit 136 may transmit the information about the respective egress path 544 and 580 to the processor 138. The processor 138 may send instructions to the notification device control unit 140 to trigger output of egress notifications 564, 566, 552, 548, 532, 568, 554 and 544 (as illustrated in FIG. 5 with dotted arrows) at the notification devices 502, 504, 506, 508, 510, 512, 514, 516, 518, 520, 522, 524, 526, 528, 530 and 532 in a coordinated pattern to identify and highlight the egress paths 544 and 580. For example, the notification device control unit 140 may trigger output of the egress notifications 564 from the notification device 502, the egress notification 566 from the notification device 516, the egress notification 554 from the notification devices 520, 522 and 524, the egress notification 552 from the notification devices 508, 510 and 512 in a coordinated pattern such as through audio instructions, blinking of LED lights, etc. (e.g., LED lights synchronized in time so that the egress notification from the notification device 512 is triggered immediately in time after the egress notification from the notification device 510, the egress notification from the notification device 510 is triggered immediately in time after the egress notification from the notification device 508) to highlight the egress path 580. Also, the notification device control unit 140 may trigger output of the egress notification 548 from the notification devices 504 and 506 to highlight the egress path 544. Similarly, the notification device control unit 140 may trigger output of the egress notification 570 from the notification device 532, the egress notification 568 from the notification device 518 and the egress notification 550 from the notification devices 528 and 530, in a coordinated pattern to highlight the egress path 544. The direction of egress notifications from the notification devices 510, 512 and 514 on the floor 501 are reversed when compared to the direction of egress notifications from the notification devices 410, 412 and 414 on the floor 501 due to the occurrence of the alarm condition 560 on the floor 501, and the determination of the egress path 580 to avoid the alarm condition 560 by the egress path unit 136 in FIG. 5. Similarly, the direction of egress notifications from the notification devices 520, 522 and 524 on the floor 501 are reversed when compared to the direction of egress notifications from the notification devices 420, 422 and 424 on the floor 501 due to the occurrence of the alarm condition 560 on the floor 501, and the determination of the egress path 580 to avoid the alarm condition 560 by the egress path unit 136 in FIG. 5.

Figure 6:
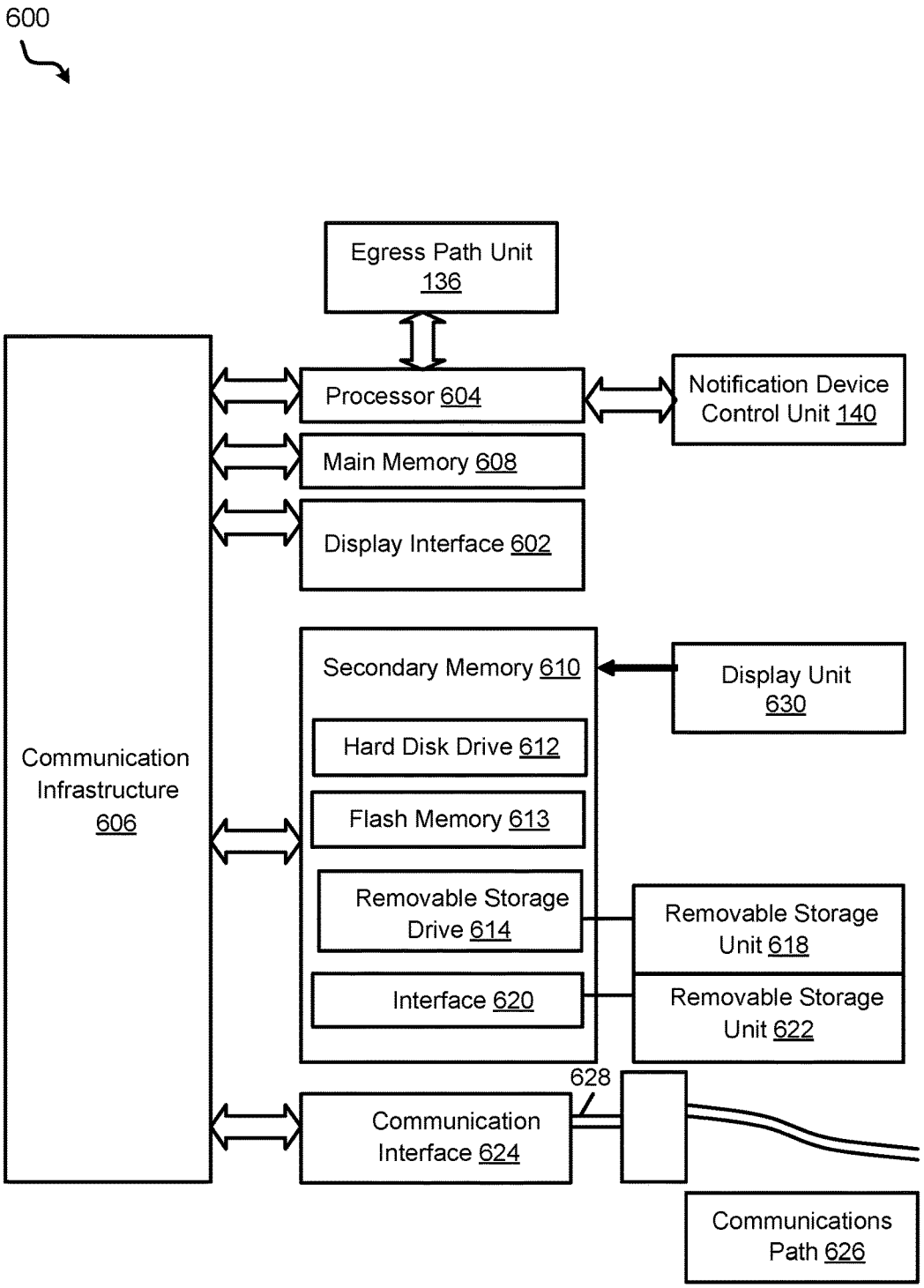
FIG. 6 is a block diagram of an example computer device including the functionality described herein to configure an emergency notification system in accordance with the present disclosure.

Referring to FIG. 6, an example of a computer device 600 operable for operating the emergency notification system may include a set of components configured in accordance with the present disclosure. The computer device 600 embodies all functionalities of the computer device 134 (as described in FIGS. 1-3). The computer device 600 includes one or more processors, such as processor 604. The processor 604 is connected to a communication infrastructure 606 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

Computer device 600 may include a display interface 602 that forwards graphics, text, and other data from the communication infrastructure 606 (or from a frame buffer not shown) for display on a display unit 630. Computer device 600 also includes a main memory 608, preferably random access memory (RAM), and may also include a secondary memory 610. The secondary memory 610 may include, for example, a hard disk drive 612, a flash memory 613, and/or a removable storage drive 614, representing a floppy disk drive, a magnetic tape drive, an optical disk drive, a universal serial bus (USB) flash drive, etc. The removable storage drive 614 reads from and/or writes to a removable storage unit 618 in a well-known manner. Removable storage unit 618 represents a floppy disk, magnetic tape, optical disk, USB flash drive etc., which is read by and written to removable storage drive 614. As will be appreciated, the removable storage unit 618 includes a computer usable storage medium having stored therein computer software and/or data.

The computer device 600 also includes the egress path unit 136 interfaced to the processor 604 of the computer device 600. The processor 604 may be coupled with the notification device control unit 140. The notification device control unit 140 and the egress path unit 136 have similar functions as described in FIG. 1. The processor 604 embodies all functionalities of the processor 138 (FIG. 1). The processor 604 of the computer device 600 may be coupled to the egress path unit 136 with the egress path unit 136 implemented as a standalone device. The processor 604 may perform one or more operations by processing the instructions stored in the respective units to perform the operations of the respective unites as described in FIGS. 1, 2 and 3.

Alternative aspects of the present disclosure may include secondary memory 610 and may include other similar devices for allowing computer programs or other instructions to be loaded into computer device 600. Such devices may include, for example, a removable storage unit 622 and an interface 620. Examples of such may include a program cartridge and cartridge interface (such as that found in video game devices), a removable memory chip (such as an erasable programmable read only memory (EPROM), or programmable read only memory (PROM)) and associated socket, and other removable storage units 622 and interfaces 620, which allow software and data to be transferred from the removable storage unit 622 to computer device 600.

Computer device 600 may also include a communications interface 624. Communications interface 624 allows software and data to be transferred between computer device 600 and external devices. Examples of communications interface 624 may include a modem, a network interface (such as an Ethernet card), a communications port, a Personal Computer Memory Card International Association (PCMCIA) slot and card, etc. Software and data transferred via communications interface 624 are in the form of signals 628, which may be electronic, electromagnetic, optical or other signals capable of being received by communications interface 624. These signals 628 are provided to communications interface 624 via a communications path (e.g., channel) 626. This path 626 carries signals 628 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 618, a hard disk installed in hard disk drive 612, and signals 628. These computer program products provide software to the computer device 600. Aspects of the present disclosure are directed to such computer program products.

Computer programs (also referred to as computer control logic) are stored in main memory 608 and/or secondary memory 610. Computer programs may also be received via communications interface 624. Such computer programs, when executed, enable the computer device 600 to perform the features in accordance with aspects of the present disclosure, as discussed herein. In particular, the computer programs, when executed, enable the processor 604 to perform the features in accordance with aspects of the present disclosure. Accordingly, such computer programs represent controllers of the computer device 600.

In an aspect of the present disclosure where the disclosure is implemented using software, the software may be stored in a computer program product and loaded into computer device 600 using removable storage drive 614, hard drive 612, or communications interface 620. The control logic (software), when executed by the processor 604, causes the processor 604 to perform the functions described herein. In another aspect of the present disclosure, the system is implemented primarily in hardware using, for example, hardware components, such as application specific integrated circuits (ASICs). Implementation of the hardware state machine so as to perform the functions described herein will be apparent to persons skilled in the relevant art(s).

As used herein, an element or step recited in the singular and proceeded with the word "a" or "an" should be understood as not excluding plural elements or steps, unless such exclusion is explicitly recited. Furthermore, references to "one embodiment" are not intended to be interpreted as excluding the existence of additional embodiments that also incorporate the recited features.

The various embodiments or components described above, for example, the notification device control unit, the egress path unit, the computing device, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system. As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A method of communicating an emergency notification, comprising:

receiving, by a processor, an alarm notification from a detection device, wherein the alarm notification corresponds to an alarm condition sensed by the detection device within a space;

detecting, by the processor, an alarm condition location of the alarm condition by determining a detection device location of the detection device and determining the alarm condition location of a source of the alarm notification based on the detection device location and one or more categorized locations in a vicinity of the detection device;

determining, by the processor, an exit location of an exit to avoid the alarm condition that triggered the alarm notification;

determining, by the processor, an egress path within the space to avoid the alarm condition based on the exit location and the alarm condition location; and transmitting, by the processor, a plurality of commands to a plurality of notification devices within the space to trigger output of an egress notification in a coordinated pattern to identify the egress path, wherein the plurality of commands trigger audible outputs by the plurality of notification devices.

2. The method of claim 1, further comprising generating, by the plurality of notification devices, the audible outputs in the coordinated pattern in response to receiving the plurality of commands.

3. The method of claim 1, wherein the alarm condition comprises a first alarm condition, and the egress path comprises a first set of egress paths based on a first alarm condition location of the first alarm condition, and further comprising:

receiving a second alarm notification from a second detection device, wherein the second alarm notification corresponds to a second alarm condition sensed by the second detection device within the space;

detecting a second alarm condition location of the second alarm condition based on a second detection device location of the second detection device, wherein the second alarm condition location is different from the first alarm condition location;

determining a second egress path within the space to avoid both the first alarm condition and the second alarm condition location, wherein the second egress path is different from the first set of egress paths; and transmitting a plurality of second commands to a second plurality of notification devices within the space to trigger output of a second egress notification in a second coordinated pattern to identify the second egress path, wherein the plurality of second commands trigger second audible outputs by the second plurality of notification devices.

4. The method of claim 1, wherein the alarm condition comprises a first alarm condition, and the egress path comprises a first set of egress paths based on a first alarm condition location of the first alarm condition, and further comprising:

receiving a second alarm notification from a second detection device, wherein the second alarm notification corresponds to a second alarm condition sensed by the second detection device within the space;

detecting a second alarm condition location of the second alarm condition based on a second detection device location of the second detection device, wherein the second alarm condition location is different from the first alarm condition location;

determining unavailability of a second egress path within the space to avoid both the first alarm condition and the second alarm condition location, wherein the second egress path is different from the first set of egress paths; and transmitting a plurality of second commands to the plurality of notification devices to output a second egress notification, wherein the second egress notification comprises a non-directional notification.

5. The method of claim 1, wherein determining the exit location comprises:

determining candidate exit locations based on the alarm condition location;

determining a nature of the alarm condition that triggered the alarm notification based on input from one or more detection devices in a vicinity of the alarm condition;

determining that a first subset of candidate exit locations are ineffective locations based on the first subset of candidate exit locations and the nature of the alarm condition;

determining that a second subset of candidate exit locations are effective locations based on the second subset of candidate exit locations and the nature of the alarm condition; and identifying at least one of the second subset of candidate exit locations as the exit location.

6. The method of claim 5, wherein determining the nature of the alarm condition that triggered the alarm notification comprises one or any combination of:

determining that a heat value recorded by a heat sensor is above a threshold heat value;

determining that a pressure value recorded by a pressure sensor is above a threshold pressure value;

determining that a light intensity recorded by a light sensor is above a threshold light intensity;

determining that a noise value recorded by a microphone is above a threshold noise value; or determining that a smoke density recorded by a smoke sensor is above a threshold smoke density value.

7. The method of claim 5, wherein determining the egress path comprises:

determining a set of candidate egress paths between the alarm condition location and each of the candidate exit locations;

determining a first subset of candidate egress paths from the set of candidate egress paths as being ineffective egress paths, wherein the ineffective egress paths include the alarm condition location or include an area in the vicinity of the alarm condition location;

determining a second subset of candidate egress paths from the set of candidate egress paths as being effective egress paths; and identifying at least one of the second subset of candidate egress paths as the egress path.

8. The method of claim 1, wherein the alarm condition comprises a first alarm condition in a first area of a building, and the egress path comprises a first set of egress paths based on a first alarm condition location of the first alarm condition, and further comprising:

a second area of the building without an alarm condition;

detecting, a first alarm condition location of the first alarm condition;

determining, a first exit location of a first exit to avoid the first alarm condition in the first area of the building;

determining, a first egress path within the first area to avoid the first alarm condition based on the first exit location and the first alarm condition location;

transmitting, a first plurality of commands to a first plurality of notification devices within the first area to trigger output of an egress notification in a coordinated pattern to identify the first egress path, wherein the first plurality of commands trigger audible outputs by the first plurality of notification devices;

determining a second set of exit locations within the second area and a set of second egress paths within the second area based on distance between each of the second set of exit locations and one or more nodal points in the second area; and transmitting, a second plurality of commands to a second plurality of notification devices within the second area to trigger output of one or more egress notifications in a coordinated pattern to identify the set of second egress paths, wherein the second plurality of commands trigger audible outputs by the second plurality of notification devices.

9. The method of claim 1, wherein transmitting the plurality of commands to the plurality of notification devices comprises:

transmitting a set of visual output commands to a set of visual notification devices to trigger a coordinated visual output that indicates the egress path; and transmitting a set of audible output commands to a set of audible notification devices to trigger the audible outputs.

10. The method of claim 9, wherein transmitting the set of visual output commands to the set of visual notification devices comprises transmitting to a set of building lighting devices different from the plurality of notification devices.

11. The method of claim 1, wherein transmitting the plurality of commands to trigger output of the egress notification in the coordinated pattern comprises a pattern that indicates directional information to identify the egress path.

12. The method of claim 1, wherein transmitting the plurality of commands to trigger output of the egress notification in the coordinated pattern comprises a pattern to simulate a Doppler effect to indicate directional information.

13. A computer device for providing an effective egress path, comprising:

a memory;

a communication interface;

an egress path unit;

a notification device control unit; and a processor in communication with the memory and configured to:

receive an alarm notification from a detection device, wherein the alarm notification corresponds to an alarm condition sensed by the detection device within a space;

detect an alarm condition location of the alarm condition by determining a detection device location of the detection device and determining the alarm condition location of a source of the alarm notification based on the detection device location and one or more categorized locations in a vicinity of the detection device;

determine an exit location of an exit to avoid the alarm condition that triggered the alarm notification;

determine an egress path within the space to avoid the alarm condition based on the exit location and the alarm condition location; and transmit a plurality of commands to a plurality of notification devices within the space to trigger output of an egress notification in a coordinated pattern to identify the egress path, wherein the plurality of commands trigger audible outputs by the plurality of notification devices.

14. The computer device of claim 13, wherein the alarm condition comprises a first alarm condition, and the egress path comprises a first set of egress paths based on a first alarm condition location of the first alarm condition, and wherein the processor is further configured to:

receive a second alarm notification from a second detection device, wherein the second alarm notification corresponds to a second alarm condition sensed by the second detection device within the space;

detect a second alarm condition location of the second alarm condition based on a second detection device location of the second detection device, wherein the second alarm condition location is different from the first alarm condition location;

determine a second egress path within the space to avoid both the first alarm condition and the second alarm condition location, wherein the second egress path is different from the first set of egress paths; and transmit a plurality of second commands to a second plurality of notification devices within the space to trigger output of a second egress notification in a second coordinated pattern to identify the second egress path, wherein the plurality of second commands trigger second audible outputs by the second plurality of notification devices.

15. The computer device of claim 13, wherein the alarm condition comprises a first alarm condition, and the egress path comprises a first set of egress paths based on a first alarm condition location of the first alarm condition and the processor is further configured to:

receive a second alarm notification from a second detection device, wherein the second alarm notification corresponds to a second alarm condition sensed by the second detection device within the space;

detect a second alarm condition location of the second alarm condition based on a second detection device location of the second detection device, wherein the second alarm condition location is different from the first alarm condition location;

determine unavailability of a second egress path within the space to avoid both the first alarm condition and the second alarm condition location, wherein the second egress path is different from the first set of egress paths; and transmit a plurality of second commands to the plurality of notification devices to output a second egress notification, wherein the second egress notification comprises a non-directional notification.

16. The computer device of claim 13, wherein the processor configured to determine the exit location comprises the processor configured to:

determine candidate exit locations based on the alarm condition location;

determine a nature of the alarm condition that triggered the alarm notification based on input from one or more detection devices in a vicinity of the alarm condition;

determine that a first subset of candidate exit locations are ineffective locations based on the first subset of candidate exit locations and the nature of the alarm condition;

determine that a second subset of candidate exit locations are effective locations based on the second subset of candidate exit locations and the nature of the alarm condition; and identify at least one of the second subset of candidate exit locations as the exit location.

17. The computer device of claim 16, wherein the processor configured to determine the egress path comprises, the processor configured to:

determine a set of candidate egress paths between the alarm condition location and each of the candidate exit locations;

determine a first subset of candidate egress paths from the set of candidate egress paths as being ineffective egress paths, wherein the ineffective egress paths include the alarm condition location or include an area in the vicinity of the alarm condition location;

determine a second subset of candidate egress paths from the set of candidate egress paths as being effective egress paths; and identify at least one of the second subset of candidate egress paths as the egress path.

18. The computer device of claim 13, wherein the processor configured to transmit the plurality of commands to the plurality of notification devices comprises the processor configured to:

transmit a set of visual output commands to a set of visual notification devices to trigger a coordinated visual output that indicates the egress path; and transmit a set of audible output commands to a set of audible notification devices to trigger the audible outputs.

19. The computer device of claim 13, wherein the processor configured to transmit the plurality of commands to trigger output of the egress notification in the coordinated pattern comprises a pattern that indicates directional information to identify the egress path.

20. The computer device of claim 13, wherein the processor configured to transmit the plurality of commands to trigger output of the egress notification in the coordinated pattern comprises a pattern that indicates directional information to simulate a Doppler effect.

21. A non-transitory computer readable medium storing computer-executable instructions that, when executed by a processor, cause the processor to:

receive an alarm notification from a detection device, wherein the alarm notification corresponds to an alarm condition sensed by the detection device within a space;

detect an alarm condition location of the alarm condition by determining a detection device location of the detection device and determining the alarm condition location of a source of the alarm notification based on the detection device location and one or more categorized locations in a vicinity of the detection device;

determine an exit location of an exit to avoid the alarm condition that triggered the alarm notification;

determine an egress path within the space to avoid the alarm condition based on the exit location and the alarm condition location; and transmit a plurality of commands to a plurality of notification devices within the space to trigger output of an egress notification in a coordinated pattern to identify the egress path, wherein the plurality of commands trigger audible outputs by the plurality of notification devices.

22. The non-transitory computer readable medium of claim 21, wherein transmitting the plurality of commands to trigger output of the egress notification in the coordinated pattern comprises a pattern that indicates directional information to identify the egress path.

* * * * *